United States Patent [19]

Titus

[11] Patent Number: 4,694,752

[45] Date of Patent: Sep. 22, 1987

[54] FUZE ACTUATING METHOD HAVING AN ADAPTIVE TIME DELAY

[75] Inventor: John D. Titus, Phoenix, Ariz.

[73] Assignee: Motorola, Inc., Schaumburg, Ill.

[21] Appl. No.: 914,405

[22] Filed: Oct. 2, 1986

[51] Int. Cl.[4] ..... F42C 11/06; F42C 15/40

[52] U.S. Cl. ..... 102/215; 102/267

[58] Field of Search ..... 102/215, 216, 206, 266, 102/267, 232

[56] References Cited

U.S. PATENT DOCUMENTS 4,455,939 6/1984 Münzel ..... 102/215

4,470,351 9/1984 Farace ..... 102/215 X 4,480,550 11/1984 Abt ..... 102/215

4,580,498 4/1986 Abt et al. ..... 102/215

*Primary Examiner*—David H. Brown

*Attorney, Agent, or Firm*—Eugene A. Parsons; Maurice J. Jones, Jr.

[57] ABSTRACT

This is a method for an adaptive delay time after impact of a projectile by determining the spin rate of the projectile using spin switches to set a time delay which may then be updated using a time of flight counter. This method may be used on artillery shells of varying calibers and each caliber of which has varying velocities.

3 Claims, 3 Drawing Figures

FIXED 4 mS DELAY BURST POINT VS. PROJECTILE SIZE

FOUR STEP
ADAPTIVE IMPACT
DELAY SYSTEM
BURST POINT
VS.
PROJECTILE SIZE

FUZE ACTUATING METHOD HAVING AN ADAPTIVE TIME DELAY

BACKGROUND OF THE INVENTION

The present invention pertains to a method for providing an adaptive delay after impact in projectiles.

In the design of projectiles fuzes for impact functiions, it is often desirable to provide for detonation of the projecticle within the target, such as an urban structure, rather than at the instant of first contact. This can be accomplisyed in myriad ways, ranging from a simple non-varying delay time between first impact and detonation to void sensing to determining detonation. Void sensors must have sufficient damping so that structural ringing does not activate them early. This results in a slow response time that makes void sensors unable to adapt to high and low velocity impacts. Similarly, fixed time delay devices of the prior art are not capable of adjusting between the varying velocities and varying sizes, that is caliber and associated length, of projectiles. In U.S. Pat. No. 4,580,498 entitled "Fuze Actuating System Having a Variable Impact Delay", issued Apr. 8, 1986, a variable impact delay has been devised which employs a set time delay after impact for a projectile with a given velocity. The delay is updated dependent upon the time of flight of the projectile. While this accomplishes the basic requirements, size and initial velocity of projectiles must remain constant for its proper functioning. It cannot be used in projectiles that are capable of varied initial velocities such as is possible in artillery shells.

SUMMARY OF THE INVENTION

The present invention is a method for providing an adaptive delay after impact in projectiles. This method is embodied in an adaptive delay after impact device which comprises a series of spin switches which determine a projectile's angular velocity and set an initial delay time, indenpendent of, but in effect proportional to the projectile size and velocity and an impact sesnsing device which starts the delay time, and may include a time of flight counter which begins after set back occurs, and which is used in a logic means for updating the delay time.

It is an object of this invention to provide a new and improved method for an adaptive delay after impact of projectiles.

It is a further object of this invention to provide a method of producing an adaptive delay time proportional to the size and the size velocity of the projectile.

It is an object of this invention to provide a method for a more accurate delay time after impact.

These and other objects of the present invention will become apparent to those skilled in the art upon consideration of the accompanying specification, claims and drawings.

DESCRIPTION OF THE PREFERRED EMBODIMENT

Figure 1:
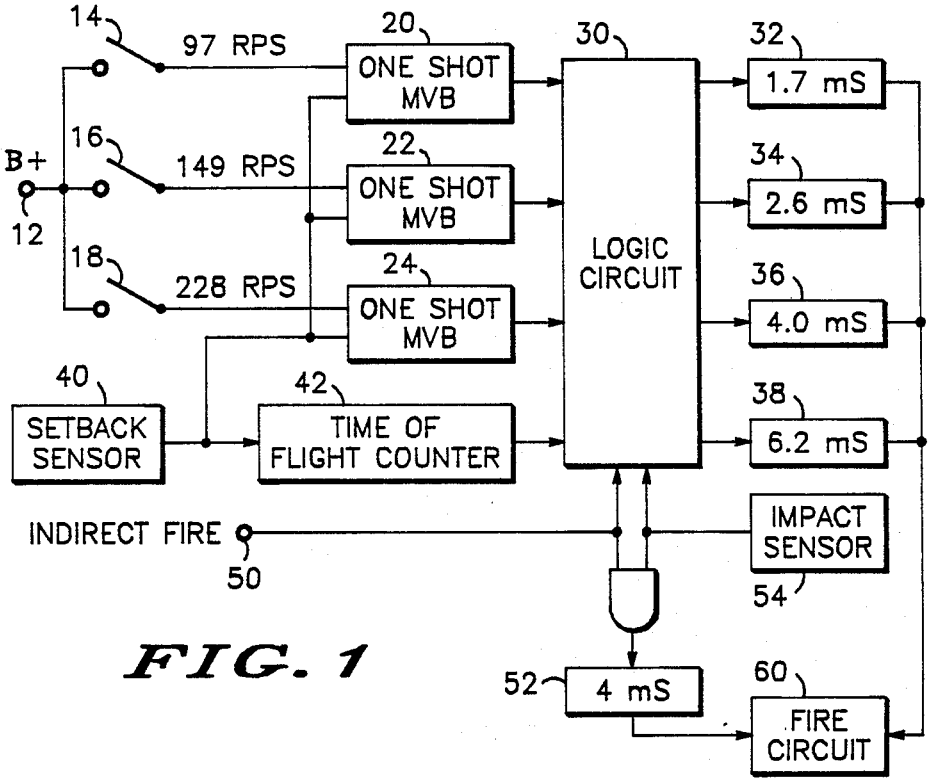
FIG. 1 is a block diagram of a fuze according to the present invention.

Referring now to the drawings, FIG. 1 is a simplified block diamgram of an embodiment of the present invention. The presenst embodiment is for a four step adaptive impact delay system which is an embodiment with three spin switches 14, 16, and 18, each of which is closed at a different rate of spin. Typical switches which might be utilized for this purpose are disclosed in U.S. Pat No. 4,543,457, entitled "Micro Miniature Force-Sensitive Switch", patented Sept. 24, 1985. When closed spin switches 14, 16 and 18 connect a reference voltage 12 to one-shot multi-vibrators 20, 22 and 24, respectively. Multi-vibrators 20, 22 and 24 convert the closing of the switches to digital signals which are then processed through a logic circuit 30. In this embodiment, four different delay circuits 32, 34, 36 and 38 providing impact delay times of 1.7 ms, 3.2 ms, 4.6 ms and 6.1 ms, respectively, are connected to outputs of logic circuit 30.

The spin switches 14, 16, and 18 each close at 97, 149, and 228 rps (revolutions per second). Based on the status of these three switches, one of the four delay circuits 32, 34, 36 and 38 is selected by logic means 30. In this embodiment, if none of the switches are closed the slowest delay time (delay circuit 38) of 6.2 milliseconds is selected. If one switch is closed, the 97 rps switch 14, the next slowest delay time (delay circuit 36) of 4.0 milliseconds is selected. If two switches are closed, switches 14 and 16 the next slowest delay time (delay circuit 34) of 2.6 milliseconds is selected. Finally, if all three switches 14, 16 and 18 are closed by the angular velocity at launch, the fastest delay (delay circuit 32) time of 1.7 millisecond is selected. It should be obvious to one skilled in the art that while the three spin switches and four different delay times have been shown, any number of spin switches and delay times may be used, with a greater accuracy imparted to an embodiment with more spin switches and delay times.

Spin switches 14, 16 and 18 with corresponding delay circuits 32, 34, 36 and 38 are activated by the angular acceleration imparted to the projectile during firing. In this example, projectiles are artillery shells which receive spin from rifling in the barrel. The same spin switchs, that is switches that are closed at the same spin rate as shown in the diagram, with corresponding time delays, apply to artillery shells of all sizes, even though shells of larger calibers travel at greater velocities when spinning at the same rate as smaller shells. This is possible because the barrels of artillery pieces are manufactured to certain specifications, which results in rifling being proportional to caliber. The length of a shell is also proportional to its caliber, thus, if travel distance is measured in calibers, a large shell traveling at a greater velocity but spinning at the same rate as a smaller shell will penetrate into a target a greater absolute distance but an equal distance in calibers. It is then desirable to function a projectile within a window of distance beyond the target proportional to the projectile size, such as a window of 7 to 12 calibers. For the impact sensor fuze to function within 7 to 12 calibers from impact, it must function 0.38 to 0.60 revolutions after impact for 1/20–1/18 twist guns. The time delays required to effect 0.39 to 0.60 revolutions to function are calculated as follows:

For a projectile spinning 350 rps the longest delay time that will assure functioning in a maximum of 0.6 revolutions is $$\frac{.60 \text{ rev}}{350 \text{ rps}} = .0017 \text{ second}$$

The slowest spinning projectile for which a 0.0017 second delay will assure functioning in a minimum of 0.39 revolutions is $$\frac{.39 \text{ rev}}{.0017 \text{ sec}} = 228 \text{ rps}$$

For a projectile spinning at or below 228 rps, the maximum time delay is $$\frac{.60 \text{ rev}}{228 \text{ rps}} = .0026 \text{ second}$$

The slowest spinning projectile which a 0.0026 second delay after impact could be used is $$\frac{.39 \text{ rev}}{.0026 \text{ rps}} = 149 \text{ rps}$$

Likewise the remaining delay parameters are calculated $$\frac{.6 \text{ rev}}{.149 \text{ rps}} = .0040 \text{ second}$$

$$\frac{.39 \text{ rev}}{.004 \text{ rps}} = 97 \text{ rps}$$

$$\frac{.6 \text{ rev}}{.97 \text{ rps}} = .0062 \text{ second}$$

$$\frac{.39 \text{ rev}}{.0062 \text{ rps}} = 62 \text{ rps}$$

Figure 2:
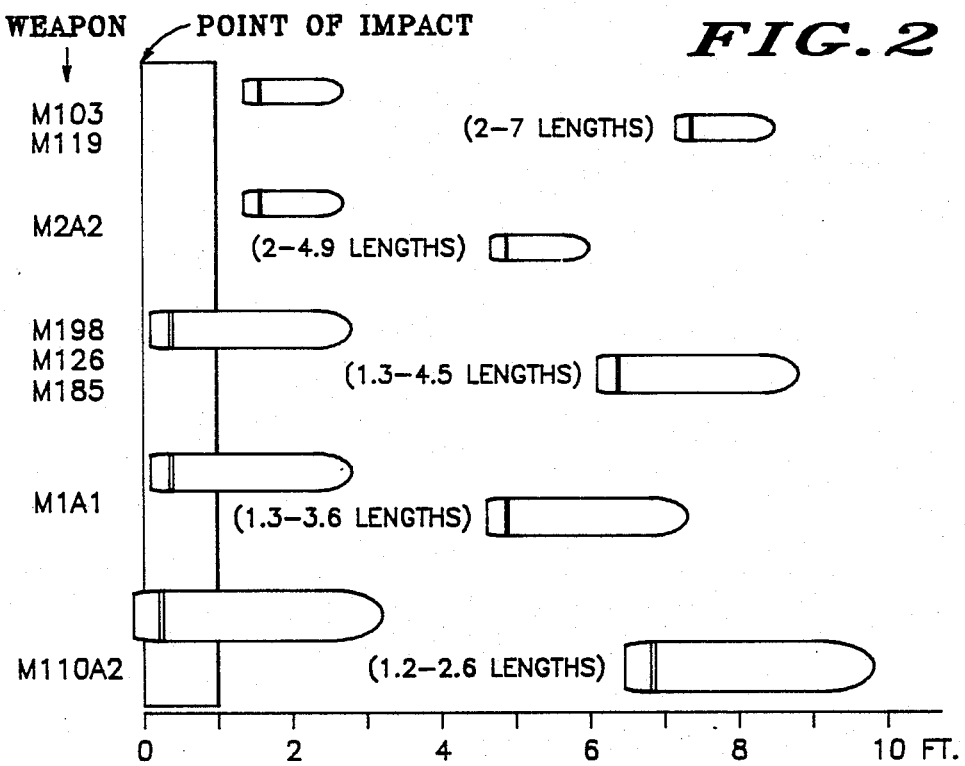
FIG. 2 is a graphical diagram of a fixed four millisecond delay burst point versus projectile size for comparison to the invention.
Figure 3:
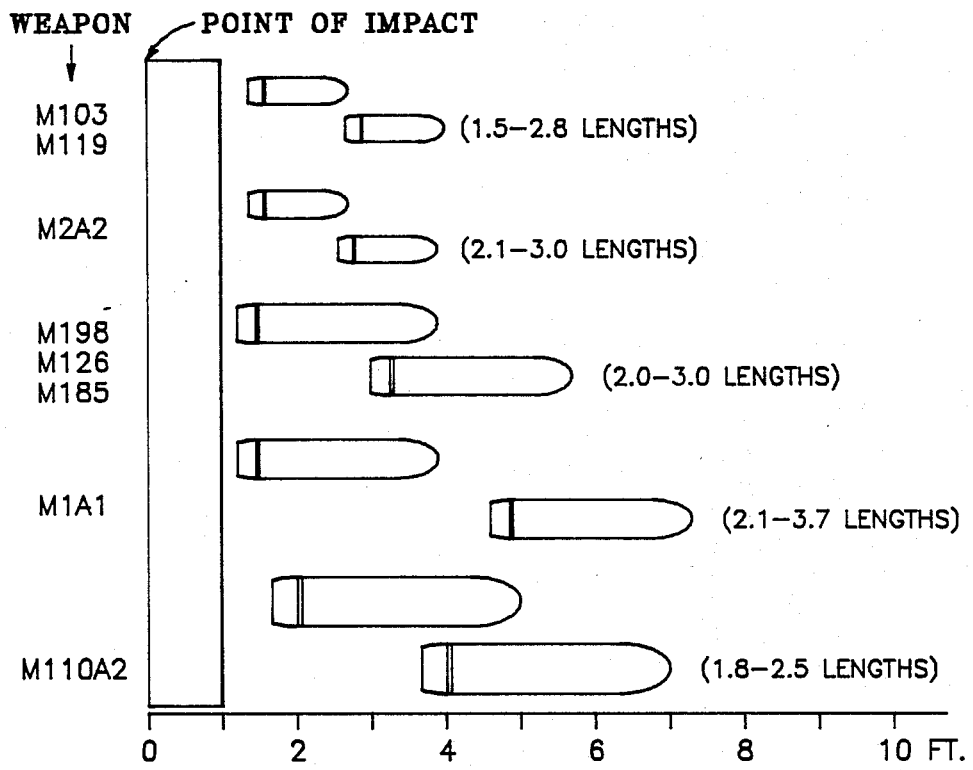
FIG. 3 is a graphical diagram of a four step adaptive impact delay system burst point versus projectile size.

FIG. 2 is a graph showing the depth of penetration before detonation, of a variety of different caliber artillery shells at a set time delay of four milliseconds. The two shells for each caliber in the figure depict the range over which each caliber shall burst, with the shortest penetration of the larger caliber shells bursting while still in the wall. This graph also shows the wide range of burst points due to the different velocities with which each shell can be fired. FIG. 3 shows a graph of the four step adaptive impact delay system burst point versus projectile size. In this graph, the shells of every caliber penetrate completely through the wall before bursting, and have a relatively small range of burst points. The M1A1 shell has a larger range of burst points due to its rifling, 1/25 revolutions per caliber (twist), which imparts a slower rate of spin to caliber than the others which have either 1/18 or 1/20 twist. This is the four step delay system, having three spin siwtches 14, 16, and 18 with related times delay circuits 32, 34, 36 and 38. If a greater number of spin switches with related time delays are added, the range of burst points for each caliber shell would be reduced.

Up to this point no velocity decay is assumed which would decrease the precision of the timing. To porvide for this circumstance, an update may be added. Referring to FIG. 1 a set back sensor 40 is used with a time of flight counter 42 to supply time of flight to logic circuit 30. An impact sensor 54 also supplies information to logic circuit 30 which can then measure the time of flight form set back to impact. Circuits wich might be used for this purpose are disclosed in the above descirbed U.S. Pat. No. 4,580,498. After a certain time of light, logic circuit 30 will drop the already set time delay to the next longest time delay as the projectile slows, such as from time delay circuit 32 to time delay circuit 34.

Another possiblilty of operation is indirect fire, selected by applying a signal to input terminal 50 at which time the time of flight counter 42 and spin switches 14, 16 and 18 are by-passed. A set time delay circuit 52, which may supply a 4 millisecond delay is used, at the end of which time fire circuit 60 is engaged.

Thus, a method has been developed whereby shells fired at varying velocities can use a variable time set.

While we have shown and described specific embodiments of this invention, further modifictions and improvements will occur to those skilled in the art. We desire it to be understood, therefore, that this invention is not limited to the particular form shown and we intend in the apppended claims to cover all modifications which do not depart from the spirit and scope of this invention.

What is claimed is:

1. A method of adaptive delay after impact of projectile comprising the steps of:

determining a spin rate of a projectile;

setting a time delay corresponding with said spin rate;

updating said time delay; and starting said time delay after impact.

2. A method of claim 1 wherein the step of determining said spin rate includes closing spin switches in a series.

3. A method of claim 1 wherein the step of updating said time delay includes closing additional spin switches after certain elapsed time of flight.

* * * * *